US007422019B2

(12) United States Patent
De Waele et al.

(10) Patent No.: US 7,422,019 B2
(45) Date of Patent: Sep. 9, 2008

(54) COMPOSITION AND METHOD FOR TREATING A SEMICONDUCTOR SUBSTRATE

(75) Inventors: Rita De Waele, Hasselt (BE); Rita Vos, Tremelo (BE)

(73) Assignee: Interuniversitair Microelektronica Centrum (IMEC) vzw, Leuven (BE)

( * ) Notice: Subject to any disclaimer, the term of this patent is extended or adjusted under 35 U.S.C. 154(b) by 0 days.

(21) Appl. No.: 11/476,263

(22) Filed: Jun. 27, 2006

(65) Prior Publication Data

US 2006/0247142 A1 Nov. 2, 2006

Related U.S. Application Data

(62) Division of application No. 11/015,483, filed on Dec. 16, 2004.

(60) Provisional application No. 60/531,526, filed on Dec. 18, 2003.

(51) Int. Cl.

| | |
|---|---|
| ***B08B 3/04*** | (2006.01) |
| ***C11D 7/26*** | (2006.01) |
| ***C11D 7/32*** | (2006.01) |
| ***C11D 7/54*** | (2006.01) |

(52) U.S. Cl. ..... 134/1.3; 510/175; 510/255; 510/264; 510/370; 510/499; 510/505

(58) Field of Classification Search ..... None
See application file for complete search history.

(56) References Cited

U.S. PATENT DOCUMENTS

| | | | | |
|---|---|---|---|---|
| 3,640,825 | A | 2/1972 | Kolaian | |
| 4,210,498 | A | 7/1980 | Tamura et al. | |
| 5,022,926 | A * | 6/1991 | Kreh et al. | 134/2 |
| 5,280,746 | A | 1/1994 | Siegel | |
| 5,290,361 | A | 3/1994 | Hayashida et al. | |
| 5,302,311 | A | 4/1994 | Sugihara et al. | |
| 5,466,389 | A | 11/1995 | Ilardi et al. | |
| 5,840,127 | A | 11/1998 | Hayashida et al. | |
| 5,885,362 | A | 3/1999 | Morinaga et al. | |
| 6,066,609 | A | 5/2000 | Martin et al. | |
| 6,319,885 | B1 * | 11/2001 | Lee et al. | 510/175 |
| 6,508,887 | B1 * | 1/2003 | Park et al. | 134/2 |
| 6,599,370 | B2 * | 7/2003 | Skee | 134/3 |
| 2004/0198621 | A1 | 10/2004 | Mun et al. | |

FOREIGN PATENT DOCUMENTS

| | | |
|---|---|---|
| DE | 264 012 0 | 11/1912 |
| EP | 0 346 139 A | 12/1989 |
| EP | 1 029 703 A | 8/2000 |
| WO | WO 03/068713 A | 8/2003 |

OTHER PUBLICATIONS

Database WPI, Section CH, Week 198626 Derwent Publications Ltd. London, GB AN 1986-166778, XP002320262 and JP 61 100919 A (Nichicon Capacitor Ltd) May 19, 1986 Abstract.

European Search Report in European Appln. No. EP 04 44 7282, completed on Mar. 11, 2005.

Mertens, et al., *Proc. Of the 5th Internat. Symp. On Cleaning Techonology in Semiconductor Device Manufacturing PV97-35* (1997).

Mertens, et al. *Proc. Of the 8th Internat. Symp on Silicon Materials Science and Technology PV98-1* (1998).

M.J. Rosen, *Surfactants and Interfacial phenomena*, 2nd Edition, John Wiley and Son, New York, (1989).

Beilsteins Handbuch der Organischen Chemie, IV. Ausg, Grundewer, BD 11, S. 294 Springer Berlin 1928.

Official Communication received in U.S. Appl. No. 11/015,483, mailed on Jun. 21, 2006.

* cited by examiner

*Primary Examiner*—Gregory R Del Cotto
(74) *Attorney, Agent, or Firm*—Knobbe Martens Olson & Bear LLP

(57) ABSTRACT

The invention relates to a method for cleaning semiconductor surfaces to achieve to removal of all kinds of contamination (particulate, metallic and organic) in one cleaning step. The method employs a cleaning solution for treating semiconductor surfaces which is stable and provokes less or no metal precipitation on the semiconductor surface.

20 Claims, 5 Drawing Sheets

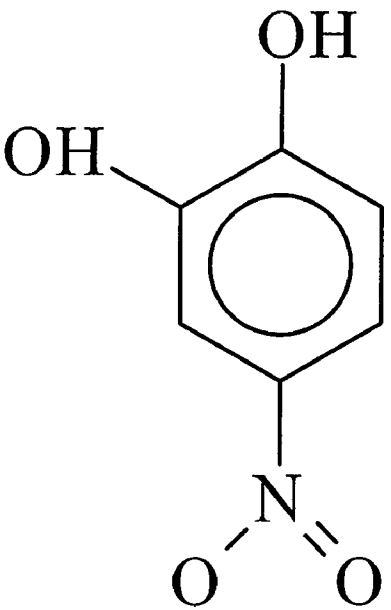
Figure 2a
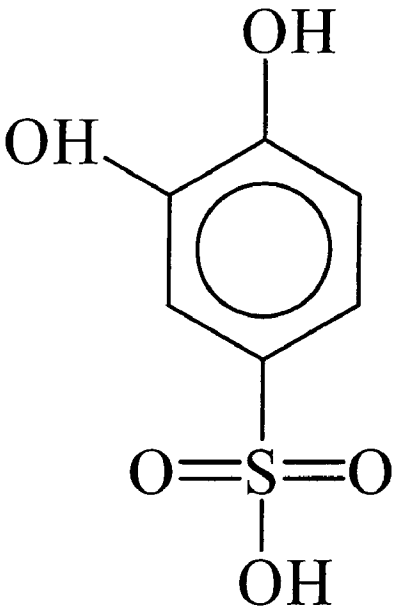
Figure 2b
Figure 2

COMPOSITION AND METHOD FOR TREATING A SEMICONDUCTOR SUBSTRATE

RELATED APPLICATION

This application is a division of application Ser. No. 11/015,483, filed Dec. 16, 2004, which claims priority under 35 U.S.C. § 119(e) to Provisional Application No. 60/531,526, filed Dec. 18, 2003, the disclosures of which are hereby incorporated by reference in their entirety and are hereby made a part of this specification.

FIELD OF THE INVENTION

The invention relates to a method for cleaning semiconductor surfaces to achieve to removal of all kinds of contamination (particulate, metallic, and organic) in one cleaning step. The method employs a cleaning solution for treating semiconductor surfaces which is stable and provokes less or no metal precipitation on the semiconductor surface.

BACKGROUND OF THE INVENTION

The conventional RCA cleaning s for semiconductor substrates consists of two steps involving different solutions: an alkaline solution, the so called SC1 solution and an acidic solution, SC2. The SC1 solution is composed of 1 part ammonia ($NH_4OH$), 1 part hydrogen peroxide ($H_2O_2$) and 5 parts ultra pure water ($H_2O$) and is often referred to as APM-cleaning (i.e. Ammonia Peroxide Mixture). Originally, it was used to remove organic residues by oxidation. Later it has been proven to be very efficient to remove particles.

A drawback of the SC1 solution is that metallic contamination such as Fe and Cu are found to catalyze the decomposition reaction of the peroxide (see e.g. Mertens et al., Proc. of the $5^{th}$ Internat. Symp. on Cleaning Technology in Semiconductor Device Manufacturing PV97-35 (1997)) leading to a decrease in the bath lifetime.

Chemical solutions comprising an oxidizing compound have often problems related to the stability of the solution. In pure form, aqueous solutions are stable over extended periods of time. However, the presence of certain metal ions in the solution causes decomposition of the oxidizing compound. Consequently, stabilizers to prevent such decomposition are preferably added. Stabilizers can include, e.g., a complexing compound, such that the complexing compound will bind to the metal, and consequently the metal is not available for reaction with the oxidizing compound. Thus, the decomposition of the oxidizing compound is substantially inhibited and the lifetime of the solution is increased.

Very stringent specifications must be met by oxidizing solutions for specialized applications such as semiconductor applications or reagent chemicals.

An overview of stabilizing oxidizing compound, and more specifically hydrogen peroxide solutions, is given in Kirk-Othmer Encyclopedia of Chemical Technology ($4^{th}$ edition), vol. 13 pg 965.

Another problem associated with SC1 cleaning solutions is that metals precipitate on silicon surfaces. Aluminum, iron and zinc especially have been shown to adsorb strongly on the wafer surface (see e.g. Mertens et al., Proc. of the $8^{th}$ Internat. Symp. On Silicon Materials Science and Technology PV98-1 (1998)). In order to remove the metallic surface contamination, the SC2 solution consisting of 1 part hydrochloric acid, 1 part hydrogen peroxide and 6 parts ultra-pure water is used. However, it is expensive to obtain hydrochloric acid of sufficient quality for the usage in SC2 solution. There is also a risk of re-contaminating the surface with particles. Problems also occur in spray tools due the corrosive behavior of hydrochloric acid.

With the progress in semiconductor manufacturing the requirements concerning particle and metal contamination as well as roughness of the silicon surfaces became more stringent. This led to a number of variations of the RCA clean.

The potential problems related to the SC2 and the consideration to reduce process time and equipment by leaving out this acidic step led to the development of single-stage cleaning procedures. This can be done by using chemicals with reduced amount of metallic impurities. For that purpose, advanced purification procedures are established for obtaining ultra-pure water, ammonia and hydrogen peroxide. However, these chemicals are very expensive and the purity is not always assured when they are used in a cleaning bath. Moreover, the cleaning solution is not very robust with respect to metal contamination from the semiconductor substrate and from the hardware.

Besides this, an extra step in the cleaning cycle to remove residual metallic contamination implies extra hardware, e.g., a SC2-tank and a rinse tank need to be used, and more chemicals. Leaving out this extra step results in a reduction of the hardware cost and a reduction of the amount of chemicals used in the cleaning cycle.

U.S. Pat. No. 5,466,389 describes cleaning solutions containing a complexing agent such as EDTA in combination with a nonionic surfactant. However, these cleaning solutions suffer from the drawback of weak stability of EDTA in peroxide containing cleaning solutions. In addition, in general, nonionic surfactants cannot be rinsed off easily from the wafer surface and traces of organic contamination are left on the wafer surface.

U.S. Pat. No. 5,885,362 describes a method for treating a surface of a substrate with a surface treatment composition. The surface treatment composition comprises a liquid medium containing a complexing agent as a metal deposition preventive. The surface treatment composition is improved by incorporating at least two complexing agents. A first complexing agent is preferably an aromatic hydrocarbon ring with at least an OH or $O^-$ group bonded to a carbon atom constituting the ring. A second complexing agent is compound having a donor atom, in the molecular structure.

U.S. Pat. Nos. 5,290,361 and 5,302,311 describe an aqueous hydrogen peroxide solution further comprising a complexing compound containing phosphonic acid groups and showing complexing ability. Cleaning solutions comprising phosphonic acid groups are not effective because enhanced deposition of Cu has been measured. In addition, there is always a risk of leaving P-contamination on the wafer surface which makes the cleaning solutions less suitable.

U.S. Pat. Nos. 5,280,746 and 5,840,127 describe the use complexing agents with hydroxamate functional groups. However, these complexing agents have limited stability in cleaning solutions containing peroxide.

U.S. Pat. No. 6,066,609 describes an aqueous cleaning solution comprising a base, hydrogen peroxide and a complexing agent being a crown ether with sidegroups able to complex metallic species. However the phosphonic acid side groups may also contribute to unwanted P contamination on the wafer surface. In addition, these complexing agents show a limited stability and a lower metal removal performance.

SUMMARY OF THE INVENTION

In the preferred embodiments, the problems related to removal of metals as mentioned above in regard to the prior art methods and solutions are avoided. The new solution for treating a surface is preferably stable and provokes less or no metal precipitation on the surface.

A new single-step method is provided for cleaning semiconductor surfaces so as to removal of all kinds of contamination (particulate, metallic and organic) in one cleaning step.

In a first aspect, a composition is provided comprising an alkaline compound and a complexing compound having a chemical formula as depicted Formula I:

Formula I

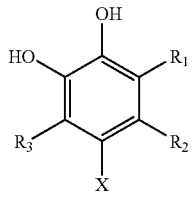

wherein X is selected from the group consisting of $NO_2$ and $SO_3H$; and wherein $R_1$, $R_2$, and $R_3$ are independently selected from the group consisting of a hydrocarbyl group and hydrogen.

In an embodiment of the first aspect, $SO_3H$ is in an acidic form or in a form of a salt.

In an embodiment of the first aspect, the composition further comprises an oxidizing compound.

In an embodiment of the first aspect, the composition is in the form of an aqueous composition.

In an embodiment of the first aspect, $R_1$, $R_2$, and $R_3$ are hydrogen.

In an embodiment of the first aspect, the hydrocarbyl group is an alkyl chain.

In an embodiment of the first aspect, the hydrocarbyl group is selected from the group consisting of methyl, ethyl, propyl, isopropyl, and butyl.

In an embodiment of the first aspect, the complexing compound has a chemical formula as represented in Formula II:

Formula IIa

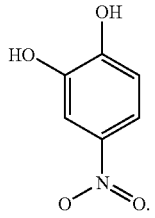

In an embodiment of the first aspect, the complexing compound has a chemical formula as represented in Formula IIb:

Formula IIb

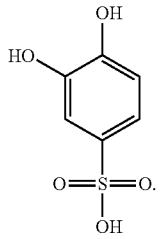

In an embodiment of the first aspect, the alkaline compound comprises an inorganic basic compound or an organic basic compound.

In an embodiment of the first aspect, the alkaline compound is selected from the group consisting of ammonia and organic amine.

In an embodiment of the first aspect, the organic amine is selected from the group consisting of choline(hydroxyltrialkylammoniumhydroxide), guanidine compounds, alkanolamine, and tetraalkylammoniumhydroxide.

In an embodiment of the first aspect, the composition further comprises an oxidizing compound selected from the group consisting of hydrogen peroxide and an oxidizing anion.

In an embodiment of the first aspect, the composition further comprises from about 0.001 weight % to about 30 weight % of an oxidizing compound.

In an embodiment of the first aspect, the composition comprises from about 0.001 weight % to about 10 weight % of the complexing compound.

In an embodiment of the first aspect, the composition comprises from about 0.001 weight % to about 30 weight % of the alkaline compound.

In a second aspect, a method for treating a semiconductor substrate is provided, the method comprising treating the semiconductor substrate with a composition comprising a complexing compound having a chemical formula as depicted Formula I:

Formula I

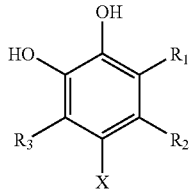

wherein X is selected from the group consisting of $NO_2$ and $SO_3H$; and wherein $R_1$, $R_2$, and $R_3$ are independently selected from the group consisting of a hydrocarbyl group and hydrogen.

In an embodiment of the second aspect, the composition is an aqueous composition.

In an embodiment of the second aspect, the composition further comprises an oxidizing compound.

In an embodiment of the second aspect, the composition further comprises an alkaline compound.

In an embodiment of the second aspect, $R_1$, $R_2$, and $R_3$ are hydrogen.

In an embodiment of the second aspect, the hydrocarbyl group is an alkyl chain.

In an embodiment of the second aspect, the hydrocarbyl group is selected from the group consisting of methyl, ethyl, propyl, isopropyl, and butyl.

In an embodiment of the second aspect, the complexing compound has a chemical formula as represented in Formula II:

Formula IIa

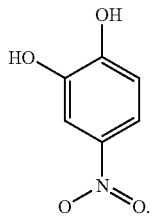

In an embodiment of the second aspect, the complexing compound has a chemical formula as represented in Formula IIb:

Formula IIb

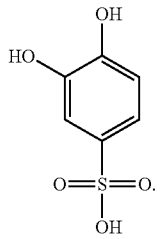

In an embodiment of the second aspect, the composition further comprises an oxidizing compound selected from the group consisting of hydrogen peroxide and an oxidizing anion.

In an embodiment of the second aspect, the composition further comprises an alkaline compound comprising an inorganic basic compound or an organic basic compound.

In an embodiment of the second aspect, the alkaline compound is selected from the group consisting of ammonia and organic amine.

In an embodiment of the second aspect, the organic amine is selected from the group consisting of choline(hydroxyltrialkylammoniumhydroxide), guanidine compounds, alkanolamine, and tetraalkylammoniumhydroxide.

In an embodiment of the second aspect, the composition further comprises from about 0.001 weight % to about 30 weight % of an oxidizing compound.

In an embodiment of the second aspect, the composition comprises from about 0.001 weight % to about 10 weight % of the complexing compound.

In an embodiment of the second aspect, the composition further comprises from about 0.001 weight % to about 30 weight % of an alkaline compound.

BRIEF DESCRIPTION OF THE DRAWINGS

FIG. 2 depicts the molecular structure of the complexing molecules according to a preferred embodiment.

DETAILED DESCRIPTION OF THE PREFERRED EMBODIMENT

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

In a preferred embodiment, a novel composition is disclosed. The composition comprises a complexing compound and an alkaline compound. The composition can further comprise an oxidizing compound. The composition can be in the form of an aqueous solution.

Figure 1:
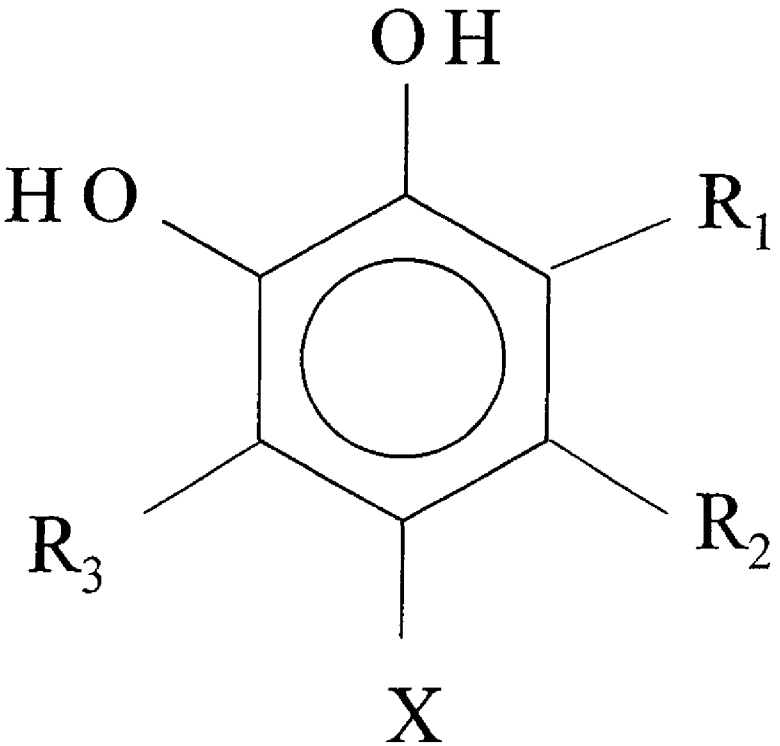
FIG. 1 depicts the molecular structure of the complexing compound.

The complexing compound can have a chemical formula as given in FIG. 1, wherein X is selected from the group consisting of $NO_2$ or $SO_3H$, and wherein $R_1$, $R_2$, and $R_3$ are a hydrocarbyl group or hydrogen. $R_1$, $R_2$, and $R_3$ can be selected from the group consisting of methyl, ethyl, or (iso) propyl or butyl. Most preferably, $R_1$, $R_2$, and $R_3$ are each hydrogen. When X is $SO_3H$, the complexing compound can be in acidic form or in the form of a salt. The salt is preferably an ammonium salt.

In another embodiment, $R_1$, $R_2$, and $R_3$ are independently selected from the group comprising hydrogen (H) or any organic group. $R_1$, $R_2$, and $R_3$ can have a different chemical structure. The organic group can be any possible sequence of C, N, O or S atoms linked to each other by single, double, or triple bonds such that the first compound complexes the desired metals. The organic group can be selected from the group comprising aliphatic side chains, heterocycles, and aromatic structures.

The organic side chain is any possible sequence of carbon atoms linked to each other by a single, double, or triple bound, and optionally is characterized by the presence of functional groups linked to the carbon atoms. Functional groups can be alcohol, carboxyl, carbonyl, aldehyde, ketone, ether, ester, amine, amide, or halogen containing groups.

The heterocycle can a crown ether, a cryptant, a calixarene, or the like.

The complexing compound preferably has a chemical structure such that at least aluminum is complexed. Furthermore, the chemical structure is such that Fe and Zn are complexed.

Although the amount of the complexing compound is not particularly limited, it is determined by the degree of metal contamination and on the kind of other compounds being present in the solution. Furthermore, the amount of complexing compound is determined by the specific chemical structure of the complexing compound. In an embodiment, the amount of the complexing agent in the composition can be from about $10^{-4}$ weight % to about 10 weight %, preferably from about $10^{-3}$ weight % to about 1 weight %.

For the purpose of the preferred embodiments, weight % is understood as the percentage of weight of the specified compound in the composition.

In a preferred embodiment, the complexing compound is represented in FIG. 2*a* or 2*b*. For the purpose of the preferred embodiments, the complexing compound represented in FIG. 2*a* will be referred to as nitrocatechol, while the complexing compound as represented in FIG. 2*b* will be referred to as sulfocatechol. The complexing compound has a chemical composition such that at least Aluminum is complexed. Moreover, iron, copper and zinc are preferably complexed.

The composition as provided in the first aspect can be used to reduce the concentration of the metals on the surface of the substrate or in a solution.

The oxidizing compound is a chemical compound having oxidizing properties towards organic species, metallic compounds, inorganic particles, silicon, and the like.

The oxidizing compound is a compound selected from the group comprising hydrogen peroxide or oxidizing anions. The oxidizing anions can be, e.g., nitric acid and its salts, nitrate, persulfate, periodate, perbromate, perchlorate, iodate, bromate and chlorate salts of ammonium. Preferably, the oxidizing compound is hydrogen peroxide.

The concentration of the oxidizing compound can be, but is not limited hereto, to from about 0.0001 weight % to about 99 weight %, preferably from about 0.001 weight % to about 90 weight %, and more preferably from about 0.001 weight % to about 30 weight %.

The alkaline compound or base can be any chemical compound with a pH higher than about 7. The alkaline compound can be an organic or inorganic compound. The alkaline compound can be an organic base, ammonia, ammonium hydroxide, or an alkaline solution containing metal ions such as potassium or sodium. The organic base can be a quaternary ammonium hydroxide such as tetraalkyl ammonium hydroxide in which the alkyl groups can contain hydroxy- and alkoxy-containing groups with 1, 2, 3, or 4 carbon atoms in the alkyl or alkoxy group. The organic base can further be an organic amine such as an alkanol amine. Alkanol amines can be 2-aminoethanol, 1-amino 2-propanol, 1-amino 3-propanol. Preferably, the alkaline compounds are tetramethyl ammonium hydroxide, and trimethyl 2-hydroxy ethyl ammonium hydroxide (choline) and ammonium hydroxide.

The amount of the alkaline compound is preferably from about 0.0001 weight % to about 90 weight % of the composition, more preferably from about 0.001 weight % to about 50 weight %, and most preferably from about 0.001 weight % to about 30 weight %.

The composition can further comprise a surfactant.

A surfactant is a surface-active agent comprising a lyophobic group and a lyophilic group. The lyophobic group can be a straight-chain alkyl group or a branched-chain alkyl group (from C8 to C20), a long-chain (from C8 to C20) alkyl benzene residue, an alkylnaphthalene residue (C3 and higher alkyl groups), high-molecular-weight propylene oxide polymers (polyoxypropylene glycol derivatives), long-chain perfluoroalkyl, or polysiloxane groups.

Depending upon the lyophilic group, the surfactant can be an anionic, cationic, nonionic or zwitterionic surfactant. Anionic surfactants can be carboxylic acids or carboxylic acid salts (such as sodium and potassium salts of straight-chain fatty acids), sulfonic acids or sulfonic acid salts (such as linear alkylbenzenesulfonates, higher alkylbenzenesulfonates, benzenesulfonates, toluenesulfonates, xylenesulfonates, and cumenesulfonates, ligninsulfonates, petroleum sulfonates, N-acyl-n-alkyltaureates, paraffin sulfonates, secondary n-alkanesulfonates, α-olefin sulfonates, sulfosuccinate esters, alkylnaphthalenesulfonates or isethionates), sulfuric acid ester salts (such as sulfated linear primary alcohols, sulfated polyoxyethylenated straight-chain alcohols or sulfated triglyceride oils), phosphoric and polyphosphoric acid esters. Cationic surfactants can be primary amines and their salts, diamines and polyamines and their salts, quaternary ammonium salts (such as tetralkylammonium salts or imidazolinium salts), polyoxyethylenated long-chain amines $[RN(CH_2CH_2O)_xH]_2$), quaternized polyoxyethylenated long-chain amines or amine oxides (such as N-alkyldimethylamine oxides). Nonionic surfactants can be polyoxyethylenated alkylphenols, polyoxyethylenated straight-chain alcohols, polyoxyethylenated polyoxypropylene glycols, polyoxyethylenated mercaptans, long-chain carboxylic acid esters (such as glyceryl and polyglyceryl esters of natural fatty acids, propylene glycol, sorbitol or polyoxyethylenated sorbitol esters, polyoxyethylene glycol esters and polyoxyethylenated fatty acids), alkanolamides, tertiary acetylenic glycols, polyoxyethylenated silicones, N-alkylpyrrolidones or alkylpolyglycosides. Zwitterionic surfactants have both anionic and cationic charges present in the lyophilic portion (such as α-N-alkylaminopropionic acids, N-alkyl-α-iminodipropionic acids, imidazoline carboxylates, N-alkylbetaines, amine oxides, sulfobetaines or sultaines) (M. J. Rosen, Surfactants and Interfacial phenomena, $2^{nd}$ Edition, John Wiley and Sons, New York, 1989).

In a preferred embodiment, the composition comprises ammonium hydroxide, hydrogen peroxide, water (hereafter called APM mixtures) and a complexing compound. The complexing compound is selected from the molecules described in FIG. 2. The composition is particularly suitable for treating, particularly cleaning a semiconductor substrate.

APM-cleaning mixtures comprising a complexing agent according to the preferred embodiments are robust with respect to metal contamination coming from the fresh chemicals as well as with respect to metal contamination introduced in the course of its use for cleaning. The robustness of the basic APM process can be improved by the addition of complexing agents that keep the metals in solution and prevent the catalysis of the peroxide decomposition.

The volume mixing ratio of $NH_4OH(29\%)/H_2O_2(30\%)/H_2O$ is preferably 0.25/1/5, but can vary depending upon various factors.

In a second aspect, a method for treating a semiconductor substrate is provided. The semiconductor substrate is treated with a composition comprising a complexing compound. In an embodiment, the composition further comprises an oxidizing compound. In another embodiment, the composition further comprises an alkaline compound. In a preferred embodiment, the composition is an aqueous composition comprising a complexing compound, an oxidizing compound and an alkaline compound. The composition can be an APM cleaning composition.

The composition can be, but is not limited hereto, the composition described in the first aspect. The composition is particularly useful for cleaning a substrate such that particles are oxidized and metallic contamination is removed. The complexing compound is for complexing metals being present on the surface of the substrate and in the solution. Additionally, the lifetime of the solution is increased since the decomposition of the oxidizing compound is substantially inhibited.

A substrate can include, but is not limited to, a substrate such as semiconducting material, glass, quartz, ceramics, metal, plastic, magnetic material, superconductor and the like.

Preferably, the substrate is a semiconductor substrate. Semiconductor substrate can be any possible substrate used in semiconductor processing. The semiconductor substrate can be a substrate selected from the group, but not limited hereto, comprising a substrate made of silicon, germanium, gallium arsenide, indium phosphide and the like.

The semiconductor substrate can include, e.g., the substrates as mentioned above covered entirely or partially with a thin film of, e.g., an oxide, a nitride, a metal, a polymeric insulating layer, an anti-reflecting coating, a barrier, a photoresist layer and the like.

The preferred embodiments are particularly relevant for cleaning or etching a semiconductor substrate for which the surface is preferably highly clean.

When the composition is used for treating a substrate, the weight concentration of the alkaline compound in the cleaning solution is typically from about 0.001 weight % to about 100 weight %, preferably from about 0.1 weight % to about 20 weight %, and more preferably from about 0.1 weight % to about 5 weight % by weight.

For ammonium hydroxide, the weight concentration of the alkaline compound in the cleaning solution is typically from about 0.001 weight % to about 30 weight %, preferably from about 0.1 weight % to about 20 weight %, and preferably from about 0.1 weight % to about 5% by weight. For other alkaline compounds, the weight concentration is similar, and a function of the strength of the alkaline compound.

For peroxide, the weight concentration the hydrogen peroxide is typically but not limited to 0.001-100%, 0.1-20% and preferably 0.1-5% by weight.

In a preferred embodiment, a composition for treating a semiconductor surface comprises ammonium hydroxide, hydrogen peroxide, water (hereafter called APM mixtures) and additionally a complexing compound. The complexing compound is selected from the molecules described in FIG. 1.

APM-cleaning mixtures comprising a complexing agent according to the preferred embodiments are robust with respect to metal contamination coming from the fresh chemicals as well as with respect to metal contamination introduced in the course of its use for cleaning. The robustness of the basic APM process can be improved by the addition of complexing agents that keep the metals in solution and prevent the above mentioned catalysis of the peroxide decomposition.

The volume mixing ratio of $NH_4OH(29\%)/H_2O_2(30\%)/H_2O$ is typically 0.25/1/5, but can vary depending upon various factors.

The cleaning solution is prepared with the amounts as described above and afterwards the semiconductor substrate is treated with the cleaning solution.

In the best mode known to the applicant, the molecule as described in FIG. 2*b* is selected and added in the amounts described above. The complexing agent can be added as the pure compound to the cleaning solution. Alternatively, the complexing agent can be dissolved in either water, ammonia or peroxide or a dilution of the two latter chemicals and added as such to the cleaning solution.

It is a further aim to provide a process for treating a semiconductor substrate comprising the steps of treating the semiconductor substrate with the cleaning solution as described above and drying the semiconductor substrate, and optionally rinsing the semiconductor substrate. The process can be performed after treating the semiconductor substrate with the cleaning solution as described above.

In the step of treating the semiconductor substrate with the cleaning solution, the semiconductor substrate can be immersed in a bath containing the cleaning solution. Alternatively, the cleaning solution can be dispensed or sprayed onto the semiconductor substrate for instance by using a spray processor. In all cases, the cleaning performance of the solution can be enhanced by using a megasonic transducer.

The temperature range for treating the semiconductor substrate with the cleaning solution is typically from about 0° C. to about 95° C., preferably from about 10° C. to about 80° C., and more preferably from about 20° C. to about 70° C.

The composition is stable in this temperature range. This is an advantage compared to prior art solutions, where the metal-complexing compound complex becomes unstable due to an increase in temperature.

In the step of drying the semiconductor substrate, several techniques known in the art can be used, e.g., spin-drying, Maragoni-drying, drying techniques using organic vapors.

The step of rinsing the semiconductor substrate comprises treating the semiconductor substrate with DI water or treating the semiconductor substrate with a diluted acidic solution or with DI water containing both complexing agents wherein the total amount is preferably from about 1 ppm to about 100000 ppm, more preferably from about 10 ppm to about 10000 ppm, and most preferably from about 100 ppm to 1000 ppm.

It is a further aim to provide a process for treating a semiconductor substrate comprising the step of treating the semiconductor substrate with any cleaning solution and/or treating the semiconductor substrate with any rinsing solution The any cleaning solution can be any cleaning solution, not being limited to the compositions described in this application. The rinsing solution comprises the first compound and the second compound, as described in the first aspect. The amount of the complexing agent in the composition can be from about $10^{-4}$ weight % to about 10 weight %, preferably from about $10^{-3}$ weight % to about 1 weight %.

This rinsing solution can also comprise a surfactant in an amount of from about 0.1 weight % to about 10 weight %.

No additional alkaline compound is typically to be added to the rinsing solution; however in certain embodiments it can be desired. The pH range of the rinsing solution is preferably from about 5 to about 8. The rinse solution can be dispensed or sprayed onto the semiconductor surface as described above. During rinsing the performance can also be enhanced by using a megasonic transducer.

The process of treating a semiconductor substrate with a cleaning solution comprising the above mentioned steps can be performed for a predetermined number of semiconductor substrates. After treating at least one substrate, but preferably after treating more substrates, the composition of the cleaning solution can be modified by, e.g., adding extra alkaline compound, adding extra complexing compound, adding oxidizing compound such that the initial composition of the cleaning solution is kept constant as function of the process time.

COMPARATIVE EXAMPLES

The preferred embodiments will be further described using non-limiting examples and drawings.

The effectiveness of the new composition concerning the inhibition of metal catalyzed decomposition of peroxide, the prevention of metal outplating on silicon wafers in metal contaminated APM cleaning solutions and the removal of metallic contamination from silicon wafer surfaces using APM cleaning solutions is described. A comparison is made with other types of complexing agents. Those complexing agents contain as functional groups either phosphonic acids, such as diethylene triamine penta-methylenephosphonic acid (DTPMP) and cyclo-triaminotriethylene-N,N',N"-tris(methylenephosphonic acid) (c-Tramp), carboxylic acids, such as ethylene diamino tetra acetic acid (EDTA), hydroxamates, such as Desferal, and other well known complexing agents as calmagite, pyrogallol, Erio T and acetylacetone. An overview of the different chemicals used for the experiments is given in Table 1. All experiments were done in a class 1000 clean room environment or better.

TABLE 1

Chemicals used for preparation of APM baths.

| Chemical | Vendor | Grade |
|---|---|---|
| $H_2O_2$ 30 (w/w)% | Ashland | TB(*) |
| $NH_4OH$ 29 (w/w)% | Ashland | TB(*) |
| EDTA | Merck | |
| DMHP | Aldrich | |
| Tiron | Aldrich | |
| acetylacetone | Aldrich | |
| Calmagite | Acros | |
| ErioT | Acros | |
| nitrocatechol | Acros | |
| sulfocatechol | ** | |
| Pyrogallol | Riedel-de-Haën | Extra pure |
| c-Tramp | | |
| Desferal | Novartis | |

(*)TB-grade corresponds with a specification of maximal 100 ppt of metal ions in the chemical.
** Prepared as mentioned in Beilsteins Handbuch der Organischen Chemie, IV. Ausg. Grundwerk, Bd.11, S.294.Springer. Berlin 1928

Example 1

Metal Deposition Experiments from APM Mixtures in Presence of Different Complexing Agents The efficiency of complexing agents to suppress the deposition of metallic contamination onto wafer surfaces was evaluated. This was done through intentionally spiking controlled trace amounts of metallic contamination to cleaning solutions. For these metal deposition tests, p-type monitor wafers with a diameter of 150 mm and <100> orientation were used. The wafers were pre-cleaned using IMEC Clean® 10' $H_2O/O_3$+10' OFR+2' 0.5% HF+10' OFR at pH 2 and $O_3$+marangoni drying, rendering a perfectly clean hydrophilic surface.

The metal deposition experiments were performed in a static quartz tank with a quartz cover plate. This tank was not equipped with a megasonic transducer. APM mixtures were prepared containing 1 w-ppb of different metals of interest with and without the complexing agent. The metals spiked to the APM bath were added from AAS-standard solutions (Merck). After a bath age of 5 minutes, three wafers were immersed for 10 minutes, rinsed for 10 minutes in an overflow rinse tank and dried with a commercially available Marangoni drier (STEAG). The resulting metal contamination was measured with straight TXRF or VPD-DSE-DC-TXRF (Vapor Phase Decomposition—Droplet Surface Etching—Droplet Collection Total X-Ray Fluorescence). Determination of Al wafer surface concentration was done using VPD-DC GF-AAS (Graphite Furnace Atomic Absorption Spectroscopy).

In Table 2, an overview of the metal deposition from intentionally metal contaminated APM cleaning mixtures and the effect of different complexing agents upon preventing the metal deposition is summarized. It is shown that nitrocatechol and sulfocatechol are very effective to prevent deposition of Al.

TABLE 2

Metal surface concentration ($10^{10}$ at/cm$^2$) after 10 min dip in 0.25/1/5 APM at 50° C. spiked with 1 w-ppb metals and different complexing agents followed by 10 min. OFR and MgDry.

| CA | Conc (M) | Fe | Zn | Al |
|---|---|---|---|---|
| None | — | 129.7 ± 3.4 | 46.82 ± 1.28 | 299.6 ± 4.6 |
| Tiron | $1.3 \times 10^{-3}$ | 0.15 ± 0.1 | 8.0 ± 0.2 | 0.7 ± 0.04 |
| DMHP | $2.7 \times 10^{-4}$ | 0.21 | 22.26 | 99.9 ± 1 |
| EDTA (70° C.) | $3.2 \times 10^{-5}$ | NA | NA | 272 ± 16 |
| EDTA (RT) | $3.2 \times 10^{-4}$ | 2.7 | 27.7 | NA |
| ErioT | $1.3 \times 10^{-4}$ | 3 ± 1.5 | 0.5 ± 0.09 | 513 ± 32 |
| Calmagite | $1.3 \times 10^{-4}$ | 64 ± 39 | 3.92 ± 0.96 | 42 ± 3 |
| Nitrocatechol + | $1.3 \times 10^{-3}$ | NA | NA | <0.126 |
| EDTA | $1.3 \times 10^{-4}$ | | | |
| sulfocatechol | $1.3 \times 10^{-3}$ | <1.2 | 13.7 ± 0.4 | <0.83 |
| Acetylacetone | $1.3 \times 10^{-3}$ | 140 ± 6 | 41 ± 3 | 319 ± 14 |
| Acetyl- | $1.3 \times 10^{-3}$ | <0.15 | 1.2 ± 0.08 | 228 ± 15 |
| acetone + | $1.3 \times 10^{-4}$ | | | |
| EDTA | | | | |
| c-tramp | $2.7 \times 10^{-5}$ | 0.82 | 0.95 | 366 ± 2.5 |
| Desferal | $2.7 \times 10^{-5}$ | 1.33 ± 0.18 | 45.6 ± 0.1 | 11.5 ± 0.18 |
| Pyrogallol | $1.3 \times 10^{-3}$ | 80.7 ± 2.4 | 30.8 ± 0.3 | 327 ± 18 |

The performance of nitrocatechol and sulfocatechol is also compared with other complexing agents. In first instance, different complexing agents for Al that are described in literature to be efficient complexants for Al are compared. Erio T, pyrogallol, EDTA, Desferal, and Tiron which known to have a good ability to complex Al (see stability constants summarized in Table 3). However, those complexants show a much lower efficiency to complex Al in the APM cleaning solution compared to nitrocatechol and sulfocatechol.

It is shown that the commonly known complexant EDTA is not able to keep the Al in solution and has also no effect on preventing the outplating of Zn. The complexing agent Tiron which has a similar ring-structure as nitrocatechol and sulfocatechol but different sidegroups, shows a comparable effectiveness in preventing metal deposition from a contaminated bath.

TABLE 3

Overview of bindings constants of different compounds for Al.(*)

| | K1 | B2 | K3 |
|---|---|---|---|
| Tiron | 19.02 | 31.1 | 2.4 |
| EDTA | 16.95 | 25.04 | — |
| Pyrogallol | 24.50 | 44.55 | 13.40 |
| calmagite | — | — | — |
| erioT | — | — | — |
| nitrocatechol | 13.75 | 25.44 | |
| Sulfocatechol** | 16.6 | 29.9 | 9.3 |
| acetylacetone | 8.6 | 16.5 | 5.8 |
| DMHP | 12.20 | 23.25 | 9.37 |
| Desferal | 24.5 | — | — |

(*)Stability constants extracted from the SCQUERY database (2002, IUPAC and Academic Software) - SCQUERY version 5.15
**L. Havelkova and M. Bartusek Coll. Czech. Chem. Commun. vol. 34 (1969)

Example 2

Removal of Metallic Contamination from Silicon Wafer Surfaces Using APM Cleaning Solutions with Different Metal Complexing Agents The final metal surface concentration after cleaning intentionally metal contaminated wafers using a 0.25/1/5 APM clean with and without any complexing agent at 50° C. is summarized in Table 4.

The metal-contaminated wafers were prepared using standard spin contamination procedure.

TABLE 4

Metal surface concentration ($10^{10}$ at/cm$^2$) after cleaning $10^{12}$ at/cm$^2$ metal contaminated wafers with 10 min 0.25/1/5 APM at 50° C. with different complexing agents (bath age = 5') followed by 10 min. OFR and MgDry.

| CA | Conc (M) | Fe | Zn | Al |
|---|---|---|---|---|
| No APM clean | | 98.75 ± 0.84 | 91.13 ± 3.03 | 177 ± 14.1 |
| None | — | 40.64 | 31.06 | 164 |
| Tiron | $1.3 \times 10^{-3}$ | 0.41 ± 0.05 | 1.8 ± 0.5 | 16.4 ± 0.25 |
| EDTA | $1.3 \times 10^{-3}$ | 0.15 ± 0.04 | 0.47 ± 0.05 | 314 ± 12 |
| ErioT | $1.3 \times 10^{-4}$ | 0.33 ± 0.09 | 1.77 ± 0.17 | 282 ± 6 |
| Calmagite | $1.3 \times 10^{-4}$ | <0.14 | 1.22 ± 0.15 | 120 ± 4 |
| Nitro-catechol | $1.3 \times 10^{-3}$ | 0.2 ± 0.1 | 18.37 ± 0.04 | 2.9 ± 0.5 |
| sulfocatechol | $1.3 \times 10^{-3}$ | <0.16 | 2.82 ± 0.17 | 6 ± 0.6 |
| Acetyl-acetone + EDTA | $1.3 \times 10^{-3}$<br>$1.3 \times 10^{-4}$ | <0.08 | 1.62 ± 0.06 | 139 ± 12 |

It can be concluded that nitro- and sulfocatechol can more efficiently clean Al from the wafer surface compared to the other complexing agents used.

Figure 3:
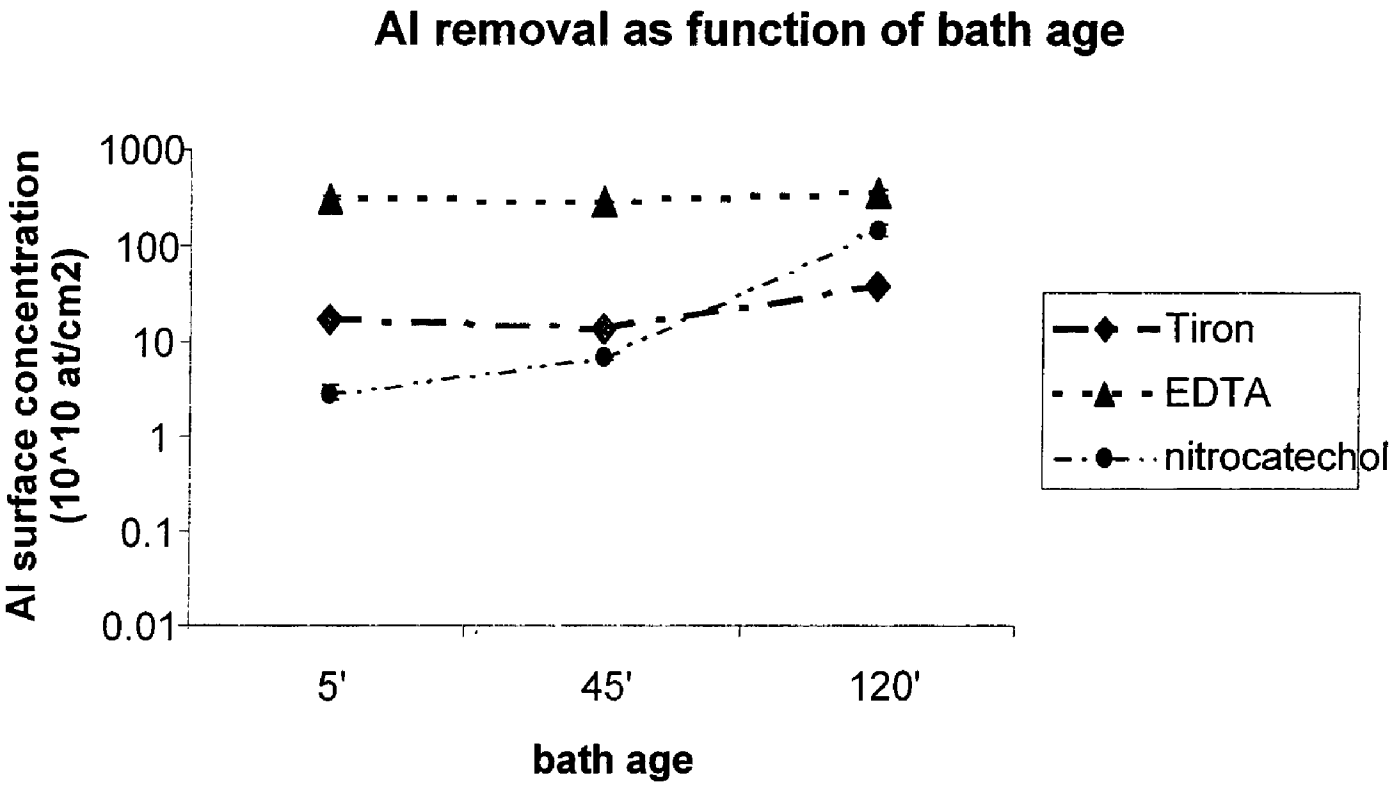
FIG. 3 depicts Fe removal efficiency of different complexing agents as function of bath age.
Figure 4:
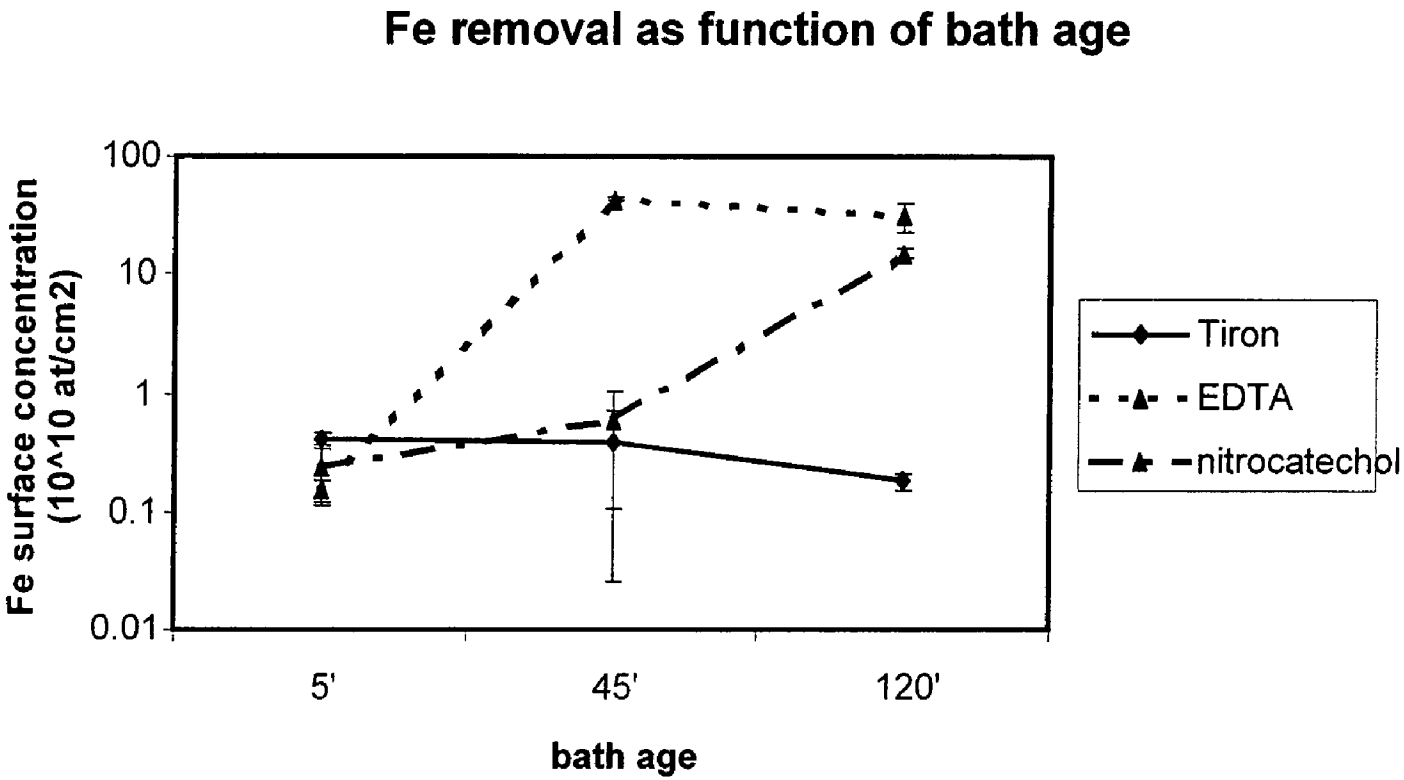
FIG. 4 depicts Fe removal efficiency of different complexing agents as function of bath age.

In FIGS. 3 and 4, the efficiency of nitrocatechol to remove metal contamination using APM mixtures is examined by investigating the removal efficiency as function of the lifetime of the complexing agents in the APM cleaning bath. A comparison is made with EDTA and Tiron. Tiron it is known to be able to complex Al contamination in APM cleaning baths.

These graphs show that nitrocatechol has a good performance concerning removal of Al from the wafer surface as a function of the bath lifetime.

Example 3

Figure 5:
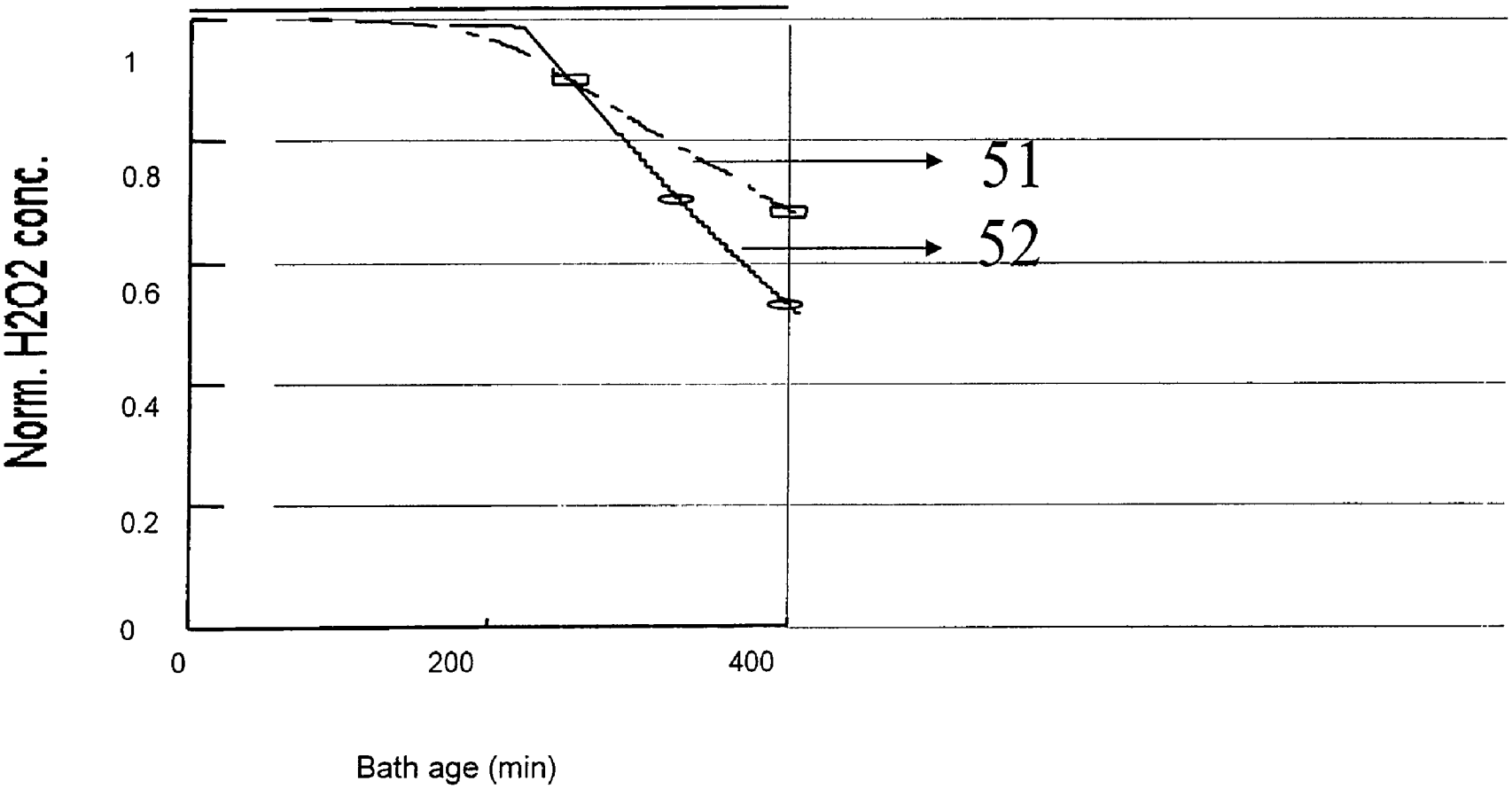
FIG. 5 depicts the effect of EDTA and nitrocatechol on the decomposition reaction of peroxide in an APM cleaning mixture.

Decomposition of Peroxide in APM Cleaning Mixtures in Presence of Trace Metal Contamination and Metal Complexing Agents The effect of the addition of a complexing agent to APM cleaning solutions on the kinetics of the decomposition reaction of $H_2O_2$ has been investigated (FIG. 5). Well controlled amounts of metallic contamination were added to the cleaning mixture under study.

As hydrogen peroxide decomposes, an amount of oxygen gas is liberated following the overall reaction $$2H_2O_2 \leftrightarrow O_2 + 2H_2O$$

The decay of the total peroxide concentration in the APM mixture can be monitored by measuring the time-dependent increase of the pressure due to the $O_2$-evolution in a dedicated set-up as described by Schmidt.

Numerical integration over time yields the actual peroxide concentration in the bath. It is convenient to use peroxide concentrations normalized to its initial value $[H_2O_2]_i$ as $$[H_2O_2]_n = \frac{[H_2O_2]}{[H_2O_2]_i}$$

Since the decomposition reaction is mainly catalyzed by Fe and in a lesser content Cu (Mertens et al. Proc. of the 5$^{th}$ Internat. Symp. on Cleaning Technology in Semiconductor Device Manufacturing PV97-35 (1997)), the decay of peroxide concentration in a metal contaminated bath and in presence of a CA, illustrates the ability of complexing primarily Fe in the APM bath.

The decomposition rate as function of bath age is determined in APM mixtures (0.25/1/5 29% $NH_4OH$/30% $H_2O_2$/$H_2O$) spiked with 1 w-ppb of the metals of interest with and without different complexing agents. The effect of different additives on the inhibition of the metal catalyzed decomposition reaction of peroxide in APM cleaning mixtures is shown in FIG. 9. This graph shows the normalized $H_2O_2$ concentration as function of bath age for an APM mixture at 50° C. spiked with nitrocatechol. A comparison is also made with EDTA. Both complexing agents were use at a concentration of $1.3 \times 10^{-3}$ M. The complexing agents are found to suppress to some extent the decomposition reaction, at least when the mixture is fresh. For EDTA the suppression action vanishes a little faster over time. This may be attributed to the destruction of the complexing agent or more specifically of the metal-complex in the hot APM. The lifetime of nitrocatechol amounts to 200 min. This value corresponds to acceptable bath lifetimes.

In FIG. 5, the dotted line refers to EDTA (51), while the full line refers to nitrocatechol (52).

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the preferred embodiments. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A method for cleaning a semiconductor substrate, the method comprising:

cleaning a semiconductor substrate with a stable cleaning composition comprising hydrogen peroxide, an alkaline compound, and a complexing compound having a chemical formula as depicted in Formula I:

Formula I

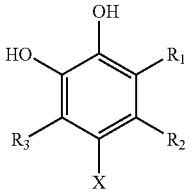

wherein X is $NO_2$; and wherein $R_1$, $R_2$, and $R_3$ are independently selected from the group consisting of a hydrocarbyl group and hydrogen, and wherein the semiconductor cleaning solution composition comprises from about 0.001 weight % to about 1 weight % of the complexing compound, whereby the semiconductor substrate is cleaned and wherein the cleaning composition does not provoke aluminum precipitation on the semiconductor substrate.

2. The method of claim 1, wherein the composition is an aqueous composition.

3. The method of claim 1, wherein the composition further comprises an oxidizing compound.

4. The method of claim 1, wherein $R_1$, $R_2$, and $R_3$ are hydrogen.

5. The method of claim 1, wherein the hydrocarbyl group is an alkyl chain.

6. The method of claim 1, wherein the hydrocarbyl group is selected from the group consisting of methyl, ethyl, propyl, isopropyl, and butyl.

7. The method of claim 1, wherein the complexing compound has a chemical formula as represented in Formula II:

Formula IIa

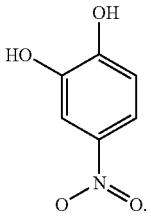

8. The method of claim 1, wherein the composition further comprises an oxidizing compound comprising an oxidizing anion.

9. The method of claim 1, wherein the alkaline compound comprises an inorganic basic compound or an organic basic compound.

10. The method of claim 1, wherein the alkaline compound is selected from the group consisting of ammonia and organic amine.

11. The method of claim 10, wherein the organic amine is selected from the group consisting of choline(hydroxyltrialkylammoniumhydroxide), guanidine compounds, alkanolamine, and tetraalkylammoniumhydroxide.

12. The method of claim 1, wherein the composition comprises from about 0.001 weight % to about 30 weight % of an oxidizing compound.

13. The method of claim 1, wherein the composition comprises from about 0.001 weight % to about 30 weight % of an alkaline compound.

14. The method of claim 1, wherein the cleaning composition does not provoke zinc precipitation on the semiconductor substrate.

15. The method of claim 1, wherein the semiconductor cleaning solution composition comprises from about 0.001 weight % to about 0.01 weight % of the complexing compound.

16. The method of claim 1, wherein the alkaline compound is ammonia.

17. The method of claim 1, wherein the alkaline compound is ammonium hydroxide.

18. The method of claim 17, wherein a volume mixing ratio of $NH_4OH$ (29%) to $H_2O_2$(30%) to $H_2O$ in the stable cleaning composition is 0.25:1:5.

19. The method of claim 1, wherein the stable cleaning composition comprises from about 0.1 weight % to about 20 weight % of the alkaline compound and from about 0.1 to about 20 weight percent hydrogen peroxide.

20. The method of claim 1, wherein the stable cleaning composition comprises from about 0.1 weight % to about 5 weight % of the alkaline compound and from about 0.1 to about 5 weight % hydrogen peroxide.

* * * * *

UNITED STATES PATENT AND TRADEMARK OFFICE

CERTIFICATE OF CORRECTION

PATENT NO. : 7,422,019 B2
APPLICATION NO. : 11/476263
DATED : September 9, 2008
INVENTOR(S) : De Waele et al.

It is certified that error appears in the above-identified patent and that said Letters Patent is hereby corrected as shown below:

| | Line | 1. Description of Error |
|---|---|---|
| On the Title Pg Item (56) Col. 2 | 16 | Under Other Publications, change "GB" to --GB Class E14,--. |
| On the Title Pg Item (56) Col. 2 | 21 | Under Other Publications, change "Techonology" to --Technology--. |
| Sheet 3 of 5 (Left Hand Side) (Figure 3) | 2 | Change "at/cm2" to --at/$cm^2$--. |
| Sheet 4 of 5 (Left Hand Side) (Figure 4) | 2 | Change "at/cm2" to --at/$cm^2$--. |
| Sheet 5 of 5 (Left Hand Side) (Figure 5) | 1 | Change "H2O2" to --$H_2O_2$--. |
| Col. 2 | 64-65 | Change "side groups" to --sidegroups--. |
| Col. 8 | 9 (Approx.) | Change "tetralkylammonium" to --tetraalkylammonium--. |
| Col. 10 | 18 | Change "Maragoni-drying," to --Marangoni-drying,--. |

Signed and Sealed this

Twenty-eighth Day of September, 2010

David J. Kappos

David J. Kappos
*Director of the United States Patent and Trademark Office*

| | | |
|---|---|---|
| Col. 10 | 29 | After “solution” insert --.--. |
| Col. 11 | 29 (Approx.) | Change “**” to --(**)--. |
| Col. 11 | 45 | Change “0.5% HF+10’” to --0.5%HF+10’--. |
| | **Line** | **Should read** |
| Col. 12 | 19-20 (Approx.) | Tables are comprised with different columns. If different rows share the same column data, it is given in the middle of the rows. Whereas, in Issued Patent, said column belong to the first row only. |
| Col. 12 | 23-25 (Approx.) | Tables are comprised with different columns. If different rows share the same column data, it is given in the middle of the rows. Whereas, in Issued Patent, said column belong to the first row only. |
| Col. 12 | 65 (Approx.) | Change “**” to --(**)--. |
| Col. 13 | 29-31 | Tables are comprised with different columns. If different rows share the same column data, it is given in the middle of the rows. Whereas, in Issued Patent, said column belong to the first row only. |
| Col. 16 | 2 (Approx.) | In Claim 8, change “comprising” to --selected from the group consisting of hydrogen peroxide and--. |
| Col. 16 | 16 (Approx.) | In Claim 12, after “composition” insert --further--. |